US005678618A

United States Patent [19]

Lindhe et al.

[11] Patent Number: 5,678,618

[45] Date of Patent: Oct. 21, 1997

[54] PROCESS FOR PRODUCING HARD ELEMENTS OF WOOD

[76] Inventors: Curt Lindhe, Mårtsbovägen 20, Söderbärke; Lennart Castwall, Kanalvägen 20, Åkersberga, both of Sweden

[21] Appl. No.: 648,029

[22] PCT Filed: Nov. 18, 1994

[86] PCT No.: PCT/SE94/01098

§ 371 Date: May 14, 1996

§ 102(e) Date: May 14, 1996

[87] PCT Pub. No.: WO95/13908

PCT Pub. Date: May 26, 1995

[30] Foreign Application Priority Data

Nov. 18, 1993 [SE] Sweden ..... 9303821

[51] Int. Cl.[6] ..... B27M 1/02

[52] U.S. Cl. ..... 144/361; 144/380; 100/93 P; 100/240

[58] Field of Search ..... 144/329, 359, 144/361, 380; 100/93 P, 237, 238, 240

[56] References Cited

U.S. PATENT DOCUMENTS

| | | | |
|---|---|---|---|
| 1,480,658 | 1/1924 | Bostock | 144/361 |
| 2,023,687 | 10/1935 | Klein | 144/380 |
| 2,586,308 | 2/1952 | Curtis | 144/380 |
| 2,787,306 | 4/1957 | Lundstrom | 244/380 |
| 2,793,859 | 5/1957 | Darling et al. | 144/380 |
| 3,166,110 | 1/1965 | Hartesveldt et al. | 144/380 |
| 4,017,980 | 4/1977 | Kleinguenther | 144/380 |
| 4,428,410 | 1/1984 | Strandberg | 144/361 |
| 4,606,388 | 8/1986 | Favot | 144/361 |
| 5,343,913 | 9/1994 | Tanahashi et al. | 144/361 |

FOREIGN PATENT DOCUMENTS

| | | |
|---|---|---|
| 0 460 235 | 12/1991 | European Pat. Off. . |
| 78054830 | 11/1979 | Sweden . |
| 446 702 | 10/1986 | Sweden . |
| 452 436 | 11/1987 | Sweden . |
| 85-247595/40 | 3/1985 | Switzerland . |
| 100792 | 12/1916 | United Kingdom . |
| 233778 | 5/1925 | United Kingdom . |
| WO 92/19702 | 11/1992 | WIPO . |

OTHER PUBLICATIONS by T. UEDA, "Microwave Recipt Yields Straight Logs", *The Nikkei Weekly*, vol. 30, No. 1521, Jun. 1992.

*Primary Examiner*—W. Donald Bray
*Attorney, Agent, or Firm*—Young & Thompson

[57] ABSTRACT

A method of producing hard wooden elements by compressing wooden blanks at an isostatic pressure greater than 800 bars, preferably greater than 1000 bars.

8 Claims, 1 Drawing Sheet

PROCESS FOR PRODUCING HARD ELEMENTS OF WOOD

FIELD OF THE INVENTION

The present invention relates to a method of producing hard wooden elements, and then in particular sawn wooden elements.

BACKGROUND OF THE INVENTION

It is known to produce hard wooden elements, such as sheets of floor boarding, by compressing different types of wood products in conventional presses. DE 0 601 162 describes one example of a wood pressing technique. Wood sheets of limited size layered with steam-heated metal plates are stacked in a steam operated press. A piston driven by pressurized steam functions to press vertically on the stack of metal plates/wood sheets from beneath the stack. Side plates are located on two of four sides, therewith enabling the wood to expand in two directions as it is compressed. Because of this possibility for the wood to expand, there is a limit on the maximum pressure to which the wood can be subjected. Deformation of the wooden sheet becomes very pronounced when the wood is subjected to high pressure, and there is also a danger that the wooden sheet will be forced out of the press. It is not therefore possible to produce hard wooden elements under very high pressures with the technique taught by DE 0 601 162.

U.S. Pat. No. 3,621,897 describes a method of pressing wooden pieces of limited size in a press mould so as to obtain a patterned surface. The wood is pretreated by immersing the wood in a water/pyridine mixture for some minutes. After being dried, the wood is pressed under hot conditions (at about 180° C.) in a metal mould that will produce the desired pattern. Nothing is mentioned as to which pressure shall be applied. According to this patent specification it is well known that the plasticity and compressibility of natural wood is very low. The pyridine treatment makes the wood soft and pliable, therewith enabling the wood to be pressed in the mould without the wood cracking. However, the pyridine impregnation process constitutes an additional treatment stage which complicates the manufacturing process. Furthermore, pyridine is a skin irritant and is extremely toxic. This technique does not allow wood to be compressed without prior impregnation of the wood with pyridine, if the wood is not to crack. This is a serious drawback, in view of the toxicity of pyridine. Furthermore, it is evident that the wood is pronouncedly deformed when practicing this technique. As shown in the figures, the wood is flattened pronouncedly when compressed. Neither does this technique enable hard wooden elements to be obtained while essentially retaining the shape of the wood after compression, since the technique is based on the wood being pressed in a mould, and moulds, after all, are not so flexible as to provide a perfect fit with each piece of wood.

U.S. Pat. No. 2,666,463 describes a wood pressing technique in which the wood is first heated quickly so as to reduce its moisture content to about 15% and to render the lignin plastic, whereafter the heated wood is pressed in a mould to reduce its volume instead of obtaining flattening of the wood at a constant volume. According to this patent specification, the wood is compressed at high pressures 800–2000 psi (55–138 bars). When pressures of these high magnitudes are applied from one direction, the material is subjected to high stresses and strains and in order to obtain an acceptable result it is necessary for the wood starting material to be even and relatively homogenous. Since knots are generally much harder than the remainder of the wood, compression of a knot-rich piece of wood is liable to give rise to ugly crack formations and may totally pulverize the knots. The pressed wooden element is also deformed to the shape of the mould used. The technique taught by U.S. Pat. No. 2,666,463 cannot therefore be applied to compress knot-rich wooden elements or wooden elements which are inhomogeneous in other ways, or to compress wooden elements of any chosen and/or irregular shapes with acceptable results.

The press devices described in the aforesaid patent specifications generate all of their pressure by pressing pistons against sheets which, in turn, distribute and forward the pressure to the blank to be pressed. No homogenous pressure load is obtained with presses of this kind, and the highest pressure on the blank is located in the centre of the sheet in a region opposite the region at which the pressing piston is attached to the sheet. The pressure then decreases further out in the peripheral region of the sheet. It is thus not possible to generate high homogenous pressures over large surface areas with the aid of the aforesaid types of press.

There is therefore a need for a method of producing hard wooden elements by packing the elements in a press where the wood will not be deformed but will essentially retain its shape although its volume will be decreased, where no toxic or otherwise unpleasant impregnation chemicals need be used, and where starting materials which contain knots inhomogeneities or irregularities will not have an impairing effect on the result or cause any significant change in shape apart from said reduction in volume. There is also a need to be able to apply high pressure forces to large surface areas in the manufacture of table tops, table leaves or flooring materials.

The present invention eliminates the aforesaid deficiencies of known techniques in an unexpected and advantageous manner.

SUMMARY OF THE INVENTION

The present invention relates to a method in which a wooden blank is compressed in a press which is capable of generating a high isostatic pressure, preferably a pressure greater than 800 bars, and even more preferably greater than 1000 bars.

The term "wooden blank" as used here denotes different types of wooden goods, such as sawn timber, particle board, chipboard, wallboard, plywood sheets, and so on.

The invention is particularly useful in connection with the processing of wood waste and surplus wood.

By isostatic pressure is meant a pressure which is equally as large in all directions in space. The pressure at an arbitrary point within a liquid or a gas mass is an example of isostatic pressure in nature. Thus, a press which generates an isostatic pressure is able to exert equally as large forces in all directions and at all points. This enables a homogenous wooden blank to be compressed with regard to volume without changing the shape of the blank. An isostatic press which operates at high pressures is able to exert the same high pressure across the whole of the outer surface of an object and not only on a small surface area thereof, as is the case with conventional presses. This enables extremely high pressures to be applied without destroying the blanks.

SE-C-452 436 describes a press of the pressure cell type. The press is used primarily within the aircraft and automobile industry for manufacturing difficultly shaped sheet metal elements in small series with the aid of a compression moulding process. A piece of sheet metal is placed on a hard substrate (tool) which has a relief image that corresponds to the desired appearance of the finished sheet metal piece and whose configuration is not changed by the pressure. A membrane, for instance, a rubber membrane, is mounted on the sheet-metal workpiece. The pressure is then generated, by pumping pressurized hydraulic fluid behind the membrane, so as to transfer the substrate image onto the sheet-metal workpiece.

It has now been found that a press of the kind described in SE-C-452 436 can be used in a manner which causes the press to exert an isostatic pressure on a blank. When the hard substrate or tool mentioned above is replaced with a tray which is either covered with or filled with pieces of plastic or elastomeric material, for instance rubber or elastic polyurethane, which when subjected to pressure will conform to the shape of the blank instead of shaping the blank, there is obtained a state in which the blank is subjected to isostatic pressure. The working fluid behind the membrane exerts the same pressure in all directions and because the membrane and the substrate both change their shape and conform to the blank, those pressure forces that act from outside directly on the blank will also be equally as large in all directions.

In spite of the pressure being isostatic, it is possible that the wooden blanks will be deformed slightly when subjected to pressure and become slightly narrower on that side thereof which lies proximal to the press membrane. This is because the friction against the plastic/elastic material in the tray counteracts shrinkage of the wooden blank locally. This can be alleviated partially by suitable selection of the plastic/elastic material used, and also by suitably positioning the blanks in the tray prior to applying pressure.

The inventive method cannot be applied satisfactorily to wooden blanks that have been taken from newly worked timber or from other timber that has an excessively high moisture content. Since the liquid present in the tree is not compressible, there will be no reduction in the volume of a pressed moist wooden blank. On the other hand, wooden blanks which have an excessively low moisture content will crack when subjected to pressure. The compressibility of the wooden blanks is thus governed by a moisture content within a range which has a top limit value corresponding to the maximum moisture content that can be allowed in order to obtain a desired reduction in volume, and a bottom limit value which corresponds to the highest moisture content at which the wooden blanks will begin to crack in conjunction with the pressing operation. This range varies between different types of wood and different wood qualities. The person skilled in this art, however, will be able to assess whether or not a batch of wooden blanks can be pressed, by pressing a sample blank taken from the batch in question.

Commercially available wooden blanks having normal moisture contents can be pressed advantageously by means of the inventive method. Blanks of this kind that are subjected to extremely high pressure forces (above 800 bars, particularly above 1000 bars) obtain in this way new advantageous and unexpected properties. The volume of the wooden blanks can be reduced by half, without damaging the blanks end without changing their shapes to any appreciable extent, which must be considered particularly surprising, especially in view of the fact that in earlier techniques very low pressures have been applied in combination with impregnating the wood, in order to avoid the formation of pressure-generated cracks. The fact that the wooden blanks are not damaged and their shape essentially retained can be seen by the intactness of the growth rings, although these rings are now closer together. All wood that is accommodated in the aforesaid tray, or trough, can be pressed almost irrespective of shape while essentially retaining the original shape of the blanks, with the exception of said reduction in volume. When using a sufficiently large press arrangement, it is also possible to press a commercially acceptable surface, i.e. a surface preferably larger than 1 $m^2$.

No signs of pressure-caused crack formations have been found, despite pressing at temperatures which lie only slightly above room temperature (25°–60° C.) and despite not previously impregnating the wood with some plasticizing substance. Knots present in the wood are also compressed and remain intact.

As beforementioned, wood that has been pressed by means of the inventive method has clearly improved properties over the starting material. The high pressure forces applied (higher than 800 bars, preferably higher than 1000 bars) impart to treated pine wooden blanks a hardness and durability comparable to that of oak, while softwood blanks, such as aspen blanks, obtain a hardness which enables the product to be used in the furniture industry, in the manufacture of table tops, table leaves. The density of the treated wooden blanks increases of course, and oak that has been pressed in accordance with the invention will sink in water for instance. Because of its compressed structure, wood that has been pressed in accordance with the invention will not ignite or burn as readily as natural wood. Normally, only the outermost surfaces of wood treated in accordance with the invention will be blackened when coming into direct contact with fire.

DETAILED DESCRIPTION OF THE INVENTION

Figure 1:
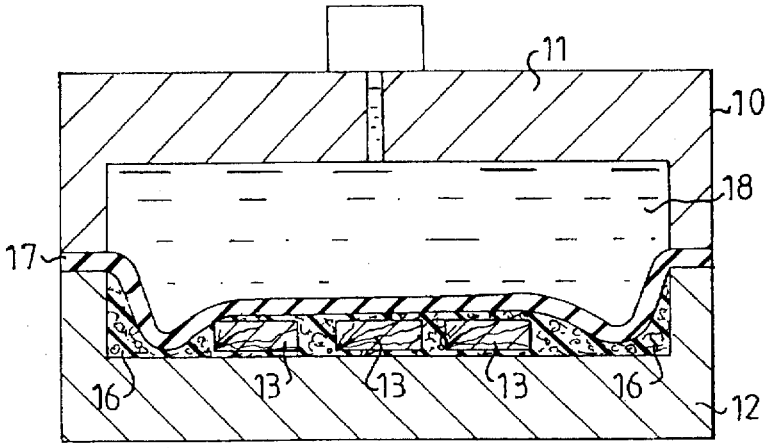
FIG. 1 is a schematic illustration of the actual press chamber.
Figure 2:
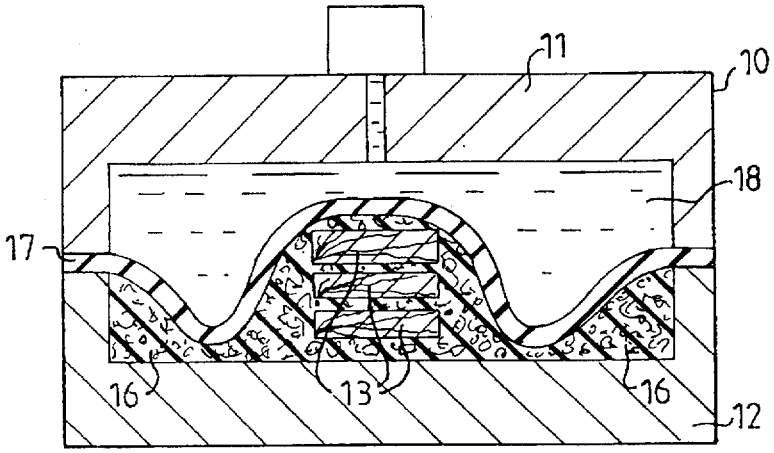
FIG. 2 illustrates the pressing of wood in the same press as that described above, but in which the blanks 13 have been mutually stacked with rubber scrap 16 disposed between each blank.
Figure 3:
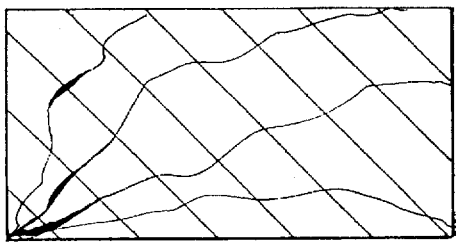
FIG. 3 illustrates the configuration of a wooden blank that has been embedded in rubber scrap in the pressing operation.
Figure 4:
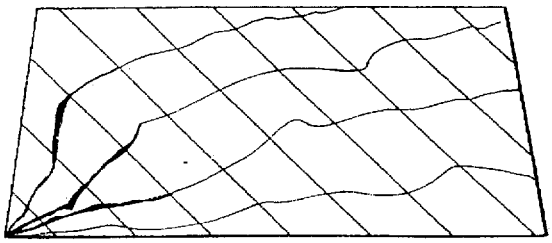
FIG. 4 illustrates the configuration of a wooden blank which has not been embedded in rubber scrap in conjunction with the pressing operation.

The invention will now be described in more detail with reference to non-limiting embodiments thereof.

The actual press is referenced 10 and includes a top part 11 and a bottom part 12 which are mutually joined in a manner (not shown) which enables the press to take-up very large pressure forces. The wooden blanks 13 have been placed on the bottom press part (the tray) 12. Rubber scrap 16 has been packed around the blanks.

The top press part includes a rubber membrane 17 which forms the bottom defining surface of a chamber 18 and which is moved together with the press part 11 down against the bottom press part at the beginning of a pressing operation. The membrane 17 therewith extends across the rubber scrap 16 and the wooden blanks 13 and the outer parts of the membrane lie against the bottom press part 12.

The chamber 18 contains a working fluid which subjects the wooden blanks to a corresponding isostatic pressure, by virtue of the membrane and the rubber scrap laying between the membrane and the blanks transmitting pressure uniformly to all parts of the blanks.

EXAMPLE 1

A pinewood blank containing knots was pressed in accordance with the inventive method. The pressure cell press used was a QUINTUS-press (ABB Pressure Systems AB, V ästerås, Sweden) which delivered a highest pressure of 1400 bars.

A part of a wooden blank was sawn off and saved for later comparison. The remainder of the wooden blanks 13 were placed on the bottom press part (the tray) 11. Rubber scrap 16 was then packed around the blanks, to fill-out cavities in the press and so that pressure would be transmitted to all sides of the blanks.

The wooden blanks were then subjected to a pressure of 1030 bars at a temperature of 35° C. for a period of 1.5 minutes. The pressure was then relieved and the press parts separated whereafter the wooden blanks were removed from the press and compared with the non-pressed sample piece. The cross-section surfaces of the wooden blanks and the hardness thereof were measured. The results of these measurements are set forth in the following table. The pressed blanks had retained their shapes and the growth rings and knots were found to be intact. The wooden blanks were subjected to a simple burning test in which it was established that the non-pressed wood sample caught fire relatively easily, whereas the pressed blanks were only lightly blackened on their respective surfaces.

TABLE 1

| | Cross-section | | Hardness |
|---|---|---|---|
| | width (mm) | height (mm) | (Rockwell) |
| Pressed blank | 65 | 22 | 99 |
| Untreated blank | 77 | 33 | 86 |

EXAMPLE 2

Oak blanks were pressed in the same press as that used in Example 1. The blanks were pressed in the same manner as that aforedescribed, although no rubber scrap was packed around the blanks, but that each blank was placed directly on an elastic rubber covering on the tray bottom. The following results were obtained:

TABLE 2

| | bottom width (mm) | top width (mm) | | height (mm) |
|---|---|---|---|---|
| Prior to pressing | 45 | 45 | 45 | 15 |
| After pressing | 43 | 38 | | 11 |

Because no rubber scrap was packed around the blanks, the upper corners were rounded, although the bottom sides of the blanks were not affected appreciably by the pressing operation.

We claim:

1. A method of producing hard wooden elements, which comprises: compressing one or more wooden blanks by applying to said wooden blanks an isostatic pressure greater than 800 bars.

2. A method according to claim 1, wherein the isostatic pressure is greater than 1,000 bars.

3. A method according to claim 1, wherein the wooden blanks are sawn wood products.

4. A method according to claim 1, wherein the isostatic pressure is applied for a total time period of less than 5 minutes.

5. A method according to claim 4, wherein the isostatic pressure is applied for a total time period of less than 3 minutes.

6. A method according to claim 1, wherein the step of compressing is carried out at a temperature of between 25° and 60° C.

7. A method according to claim 1, wherein the isostatic pressure is generated with the aid of a pressure-cell press.

8. A method of producing hardwood elements, which comprises:

placing a plurality of wooden blanks in a pressure-cell isostatic press, and compressing said wooden blanks by applying to said wooden blanks an isostatic pressure greater than 800 bars for a period of less than 5 minutes and at a temperature between 25° and 60° C.

* * * * *